US011608769B2

(12) United States Patent
Borger, Jr.

(10) Patent No.: US 11,608,769 B2
(45) Date of Patent: Mar. 21, 2023

(54) DEVICE FOR SAFELY RE-DIRECTING CARBON MONOXIDE EXHAUST FROM GENERATORS

(71) Applicant: Henry W. Borger, Jr., Clover, SC (US)

(72) Inventor: Henry W. Borger, Jr., Clover, SC (US)

( * ) Notice: Subject to any disclaimer, the term of this patent is extended or adjusted under 35 U.S.C. 154(b) by 0 days.

(21) Appl. No.: 17/694,905

(22) Filed: Mar. 15, 2022

(65) Prior Publication Data

US 2022/0298953 A1 Sep. 22, 2022

Related U.S. Application Data

(60) Provisional application No. 63/161,923, filed on Mar. 16, 2021.

(51) Int. Cl.

| | |
|---|---|
| ***F01N 13/18*** | (2010.01) |
| ***F01N 13/14*** | (2010.01) |
| ***F01N 13/08*** | (2010.01) |
| ***F23J 11/08*** | (2006.01) |

(52) U.S. Cl.

CPC ..... *F01N 13/1805* (2013.01); *F01N 13/08* (2013.01); *F01N 13/14* (2013.01); *F01N 13/1855* (2013.01); *F23J 11/08* (2013.01); *F01N 2240/20* (2013.01); *F01N 2260/20* (2013.01); *F23J 2213/20* (2013.01); *F23J 2213/202* (2013.01); *F23J 2213/203* (2013.01)

(58) Field of Classification Search

CPC ..... F01N 13/18; F01N 13/0805; F01N 13/14; F01N 13/1855; F01N 2240/20; F01N 2260/20; F23J 11/08; F23J 2213/20; F23J 2213/202; F23J 2213/203

See application file for complete search history.

(56) References Cited

U.S. PATENT DOCUMENTS

| | | | |
|---|---|---|---|
| 3,941,041 | A | 3/1976 | Sprout |
| 5,839,473 | A | 11/1998 | Caine et al. |
| 6,050,284 | A | 4/2000 | Caine et al. |
| 6,595,431 | B1 | 7/2003 | Lieske |
| 7,086,941 | B2 | 8/2006 | Ennis |
| 7,273,413 | B2 | 9/2007 | Frink |

(Continued)

OTHER PUBLICATIONS

SVA B71 Generator Exhaust Stack Extension—Sheridan, WY, GCH Construction Company, Oct. 2, 2018 (Year: 2018).*

*Primary Examiner* — Audrey B. Walter

(74) *Attorney, Agent, or Firm* — Jeffrey C. Watson; Grell & Watson Patent Attorneys LLC

(57) ABSTRACT

A device for safely re-directing carbon monoxide exhaust from generators includes a base, a holding mechanism, at least one support, and an exhaust tube. The base is configured to be positioned on a grounding surface. The holding mechanism is suspended at an elevated height from the base. The at least one support is connected between the base and the holding mechanism. The at least one support is configured to support the holding mechanism at the elevated height in a vertical orientation. The exhaust tube is configured to be connected to an exhaust outlet of the generator on a first end. The exhaust tube is configured to extend from the exhaust outlet of the generator vertically through the holding mechanism to a safe exhaust height above the exhaust outlet of the generator.

18 Claims, 3 Drawing Sheets

(56) References Cited

U.S. PATENT DOCUMENTS

| | | | |
|---|---|---|---|
| 7,306,500 | B1 | 12/2007 | Sprangler et al. |
| 8,443,792 | B2 | 5/2013 | Litzenberger |
| 9,719,680 | B2 | 8/2017 | Staller |
| 2010/0203821 | A1 | 8/2010 | Crucs |

* cited by examiner

DEVICE FOR SAFELY RE-DIRECTING CARBON MONOXIDE EXHAUST FROM GENERATORS

CROSS-REFERENCE TO RELATED APPLICATIONS

This application claims benefit to U.S. Provisional Patent Application No. 63/161,923 filed on Mar. 16, 2021, entitled DEVICE FOR SAFETY RE-DIRECTING CARBON MONOXIDE EXHAUST FROM GENERATORS, which is incorporated by reference in its entirety.

FIELD OF THE DISCLOSURE

The present disclosure relates to generators. More specifically, the present disclosure relates to a device for safely re-directing carbon monoxide exhaust from generators, like for use while camping, tailgating, the like, etc.

BACKGROUND

Generally speaking, a generator, also known as an engine-generator, is the combination of an electrical generator and an engine (prime mover) mounted together to form a single piece of equipment. This combination is also called an engine-generator set or a gen-set. In many contexts, the engine is taken for granted and the combined unit is simply called a generator. An engine-generator may be a fixed installation, part of a vehicle, or made small enough to be portable. In addition to the engine and generator, engine-generators generally include a fuel supply, a constant engine speed regulator (governor) and a generator voltage regulator, cooling and exhaust systems, and lubrication system.

The instant disclosure, although not limited thereto, may be designed and most useful for portable generators. Every year incorrectly used portable generators result in deaths from carbon monoxide poisoning. A 5.5 kW portable generator will generate the same amount of carbon monoxide as six cars, which can quickly build up to fatal levels if the generator has been placed indoors. Using portable generators in garages, or near open windows or air conditioning vents can also result in carbon monoxide poisoning.

The instant disclosure recognizes the need to provide a device and/or means for safely re-directing the carbon monoxide exhaust from such portable generators.

The instant disclosure may be designed to address at least certain aspects of the problems or needs discussed above by providing a device for safely re-directing carbon monoxide exhaust from generators.

SUMMARY

The present disclosure may solve the aforementioned limitations of the currently available generators and exhaust systems therefor, by providing a device for safely re-directing carbon monoxide exhaust from generators. The device for safely re-directing carbon monoxide exhaust from generators may generally include a base, a holding mechanism, at least one support, and an exhaust tube. The base may be configured to be positioned on a grounding surface. The holding mechanism may be suspended at an elevated height from the base. The at least one support may be connected between the base and the holding mechanism. The at least one support may be configured to support the holding mechanism at the elevated height in a vertical orientation. The exhaust tube may be configured to be connected to an exhaust outlet of the generator on a first end. The exhaust tube may be configured to extend from the exhaust outlet of the generator vertically through the holding mechanism to a safe exhaust height above the exhaust outlet of the generator.

One feature of the disclosed device for safely re-directing carbon monoxide exhaust from generators may be that the device can be configured to re-direct carbon monoxide exhaust from the exhaust outlet of the generator through the exhaust tube vertically to the safe exhaust height above the exhaust outlet of the generator into an atmosphere.

In select embodiments of the disclosed device for safely re-directing carbon monoxide exhaust from generator, the holding mechanism may include an adjustment lock. The adjustment lock may be configured to adjustably secure the exhaust tube on or inside of the holding mechanism in a vertical position. In select embodiments, the adjustment lock may be an adjustment screw in the holding mechanism configured for adjustably securing the exhaust tube on or inside of the holding mechanism in the vertical position. Wherein, the adjustment lock may be configured to adjust the vertical position of the exhaust tube on or inside of the holding mechanism at the elevated height above the base. Whereby, the exhaust tube may be configured to move vertically up and down within the exhaust tube and be secured at a required vertical exhaust height via the adjustment lock. The required vertical exhaust height of the exhaust tube may be configured for vertically positioning the first end of the exhaust tube with the exhaust outlet of the generator.

In select embodiments of the disclosed device for safely re-directing carbon monoxide exhaust from generator, the exhaust tube may include a horizontal portion and a vertical portion. The horizontal portion may include the first end configured to connect to the exhaust outlet of the generator. The vertical portion may be configured to extend vertically upward from the horizontal portion through the holding mechanism to the safe exhaust height. In select embodiments, the exhaust tube may include a bend portion with a radius. The bend portion may be connected between the horizontal portion of the exhaust tube and the vertical portion of the exhaust tube. The bend portion of the exhaust tube may bend 90 degrees from the horizontal portion to the vertical portion at the radius.

Another feature of the disclosed device for safely re-directing carbon monoxide exhaust from generator may be the inclusion of an insulated portion with the exhaust tube. The insulated portion may be configured to dissipate the heat of the carbon monoxide exhaust from the generator. The insulated portion of the exhaust tube may be positioned above the holding mechanism. In select embodiments, the insulated portion of the exhaust tube may be a heat/burn shield configured to provide a hand moveable portion of the device for manipulating the device during operation with the generator. In select embodiments of the insulated portion, the heat/burn shield may be a home gas pipe vent. In select embodiments of the insulated portion, the heat/burn shield may be configured to dissipate the heat of the carbon monoxide exhaust from the generator by 50% or more.

In select embodiments of the disclosed device for safely re-directing carbon monoxide exhaust from generator, the exhaust tube may further include a coupler. The coupler may be configured for vertically positioning the insulated portion on the exhaust tube. In select embodiments, the coupler may be a machined aluminum tube piece connected to a top end of the insulated portion of the exhaust tube. The machined aluminum tube piece may be side drilled to receive a set screw. The set screw may be configured to allow the insulated portion to be adjustably positioned vertically on the exhaust tube.

In select embodiments of the disclosed device for safely re-directing carbon monoxide exhaust from generator, the exhaust tube may include a lower exhaust pipe and an upper exhaust pipe. The lower exhaust pipe may include the horizontal portion and a lower part of the vertical portion configured to go through the holding mechanism. The upper exhaust pipe may include an upper part of the vertical portion. The upper exhaust pipe may be connected to the lower exhaust pipe via a flanged fitting.

In select embodiments of the disclosed device for safely re-directing carbon monoxide exhaust from generator, the base may have a square shape. The square shape may include four structural side members. In this square embodiment, the at least one support may include four supports connected between each corner of the square shape of the base and the holding mechanism.

Another feature of the disclosed device for safely re-directing carbon monoxide exhaust from generator may be that the base can include stabilizing base pads. The stabilizing base pads may be on a bottom side of the base. The stabilizing base pads may be configured for stabilizing the base on the grounding surface. In select embodiments, the base may include four stabilizing base pads on each corner of a square shape of the base.

In another aspect, the instant disclosure embraces the disclosed device for safely re-directing carbon monoxide exhaust from generator in any embodiment and/or combination of embodiments shown and/or described herein.

In another aspect, the instant disclosure embraces a generator with the disclosed device for safely re-directing carbon monoxide exhaust from generator in any embodiment and/or combination of embodiments shown and/or described herein.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-5, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Figure 4:
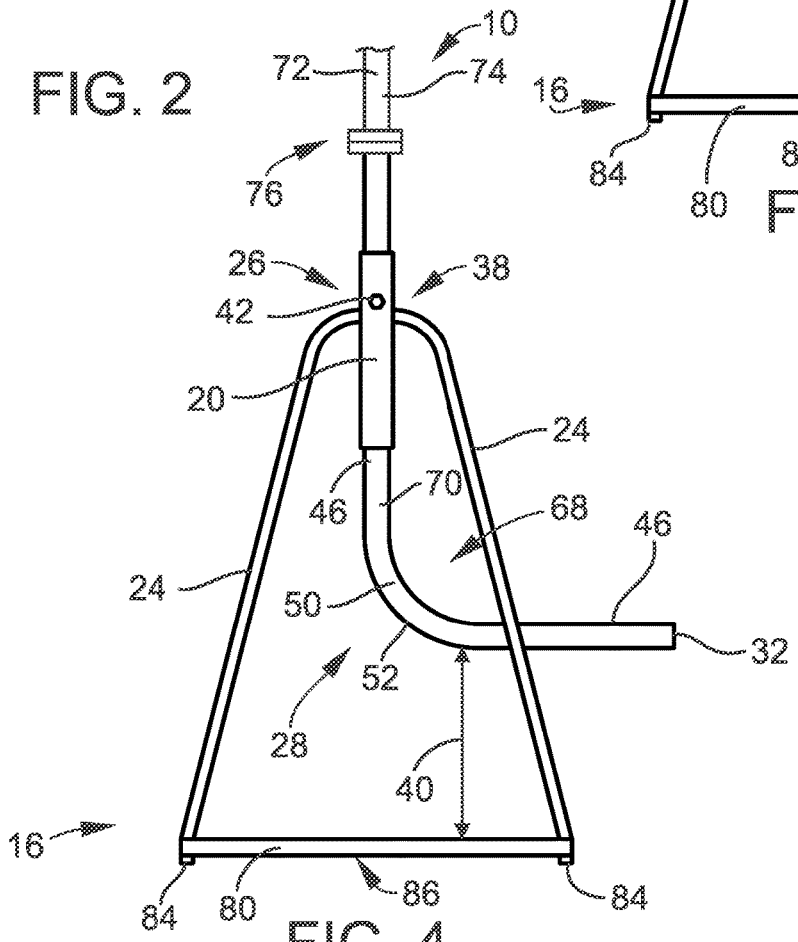
FIG. 4 is a side view of the base from FIG. 2 for the device for safely re-directing carbon monoxide exhaust from generators from FIG. 1 with the exhaust pipe installed therein.
Figure 5:
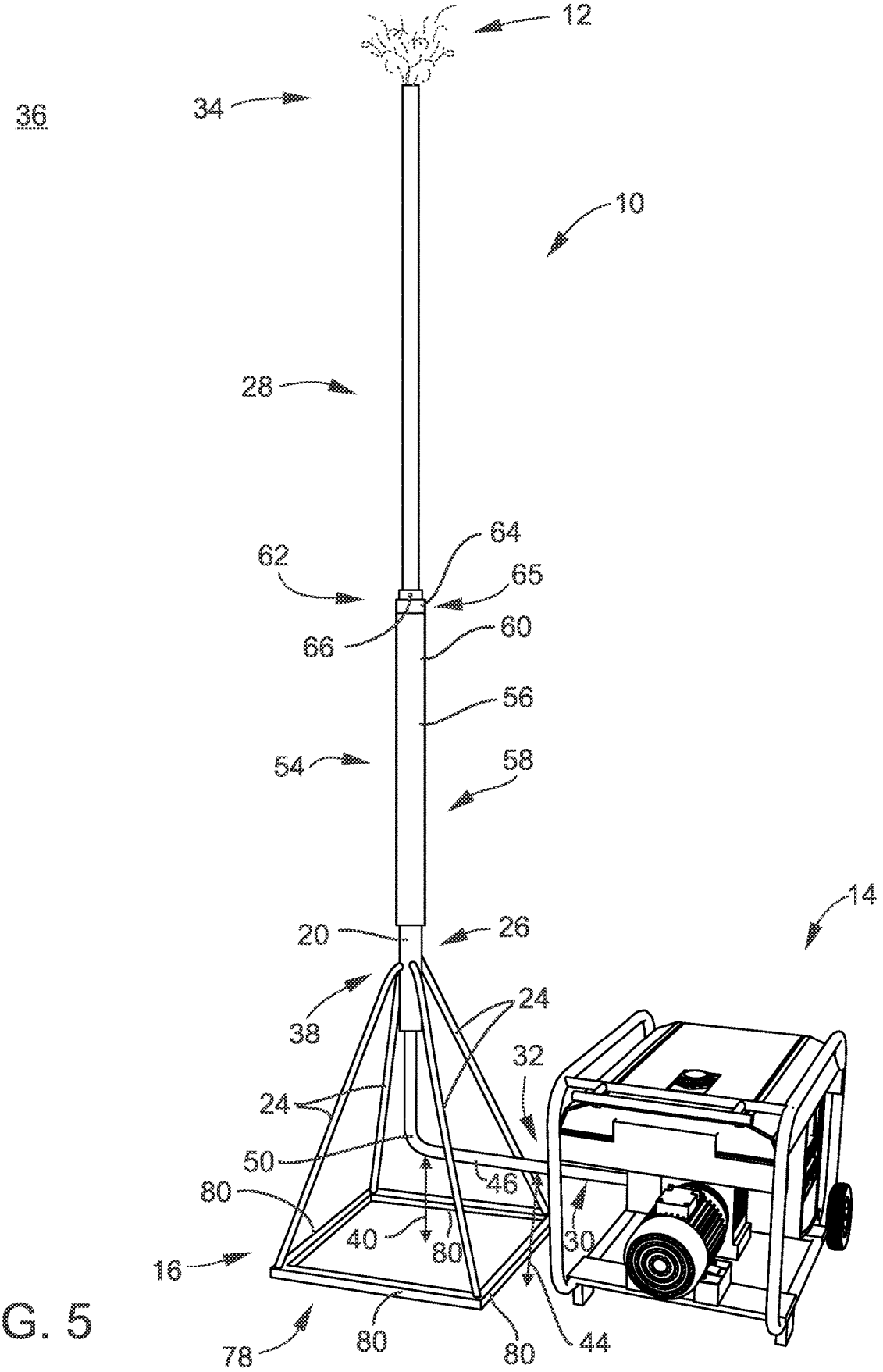
FIG. 5 is a perspective environmental view of the device for safely re-directing carbon monoxide exhaust from generators from FIG. 1 in use with a generator.

Referring to FIGS. 1-5, the present disclosure may solve the aforementioned limitations of the currently available generators and exhaust systems therefor, by providing device 10 for safely re-directing carbon monoxide exhaust 12 from generator 14 (see FIG. 5). Device 10 may be designed to provide a means and mechanism to re-direct carbon monoxide exhaust 12, or the like, from generator 14, or like device, vertically upwards to safe exhaust height 34. Once carbon monoxide gas 12 reaches safe exhaust height 34 and is released into atmosphere 36 out of exhaust tube 28, the emissions of carbon monoxide exhaust 12 may be safely re-directed up into atmosphere 36 and away from people and/or pets. Because, carbon monoxide is heavier than air, venting it upwards into atmosphere 36 may greatly reduce the dangers of this gas collecting at the ground levels while running generator 14. Device 10 for safely re-directing carbon monoxide exhaust 12 from generator 14 may generally include base 16, holding mechanism 20, at least one support 24, and exhaust tube 28. These parts of device 10 will be described in greater detail below.

Base 16 may be included with device 10 for safely re-directing carbon monoxide exhaust 12 from generator 14. See FIGS. 1-5. Base 16 may be configured to be positioned on grounding surface 18 (see FIG. 1). Base 16 may be designed and configured with stability on grounding surface 18 to prevent base 16 from being accidentally tipped over or blown over. Base 16 may include any size, shape, or materials configured to be positioned with stability on grounding surface 18. In select embodiments, as shown in the Figures, but clearly not limited thereto, base 16 may have square shape 78. Square shape 78 of base 16 may include four structural side members 80. In this square shape 78 embodiment of base 16, the at least one support 24 may include four supports 24 connected between each corner 82 of square shape 78 of base 16 and to holding mechanism 20. Another feature of device 10 for safely re-directing carbon monoxide exhaust 12 from generator 14 may be that base 16 can include stabilizing base pads 84. Stabilizing base pads 84 may be on bottom side 86 of base 16. Stabilizing base pads 84 may be configured for stabilizing base 16 on grounding surface 18. In select embodiments, as shown in the Figures, but clearly not limited thereto, base 16 may include four stabilizing base pads 84 on each corner 82 of square shape 78 of base 16.

Holding mechanism 20 may be included with device 10 for safely re-directing carbon monoxide exhaust 12 from generator 14. See FIGS. 1-5. Holding mechanism 20 may be for holding exhaust tube 28 in vertical orientation 26 elevated from base 16. Holding mechanism 20 may include any device or means for holding exhaust tube 28 in vertical orientation elevated from base 16, including, but not limited to, a center tube, as shown in the Figures. Although the instant disclosure and Figures show the holding mechanism 20 holding exhaust tube 28 in a 90-degree vertical orientation 26, the device is not so limited, and various angles of vertical orientation 26 may be utilized to re-direct carbon monoxide exhaust 12 to safe exhaust height 34. Safe exhaust height 34 may be any desired or safe height for releasing carbon monoxide exhaust 12 into atmosphere 36. In select embodiments, safe exhaust height 34 may be at least 5 feet higher than grounding surface 18 and/or exhaust outlet 30. In select possibly preferred embodiments, safe exhaust height 34 may be at least 7 feet higher than grounding surface 18 and/or exhaust outlet 30. In select possibly more preferred embodiments, safe exhaust height 34 may be at least 10 feet higher than grounding surface 18 and/or exhaust outlet 30. In select possibly most preferred embodiments, safe exhaust height 34 may be at least the height of an average enclose car trailer allowing for safe venting of CO gases into atmosphere 36, like approximately 125 inches higher than grounding surface 18 and/or exhaust outlet 30 for safe exhaust height 34. In select possibly preferred embodiments, holding mechanism 20 may be designed and configured to hold exhaust tube 28 in a 90-degree vertical orientation 26, like via the center tube shown in the Figures positioned straight up and down in vertical orientation 26. Holding mechanism 20 may be suspended at elevated height 22 from base 16. See FIGS. 1 and 3. In select embodiments of device 10, holding mechanism 20 may include adjustment lock 38. Adjustment lock 38 may be configured to adjustably secure exhaust tube 28 inside of holding mechanism 20 in vertical position 40. Adjustment lock 38 may include any means, mechanism and/or method configured to adjustably secure exhaust tube 28 on or inside of holding mechanism 20 in vertical position 40. In select embodiments, as shown in the Figures, adjustment lock 38 may be adjustment screw 42. Adjustment screw 42 may be included in holding mechanism 20, like being screwed through the center tube, as shown in the Figures. Adjustment screw 42 may be configured for adjustably securing exhaust tube 28 on or inside of holding mechanism 20 in vertical position 40. Adjustment lock 38 may be configured to adjust vertical position 40 of exhaust tube 28 on or inside of holding mechanism 20 at elevated height 22 above base 16. Whereby, exhaust tube 28 may be configured to move vertically up and down within or on exhaust tube 28, where exhaust tube 28 may be secured at required vertical exhaust height 44 via adjustment lock 38. As shown best in FIG. 5, required vertical exhaust height 44 of exhaust tube 28 may be configured for vertically positioning first end 32 of exhaust tube 28 with exhaust outlet 30 of generator 14. As such, adjustment lock 38 may be utilized for manipulating first end 32 of exhaust tube up and down vertically to match the height of exhaust outlet 30 of generator 14, including various sizes, types, configurations of generator 14, or the like, with various required vertical exhaust heights 44 of exhaust outlet 30.

At least one support 24 may be included with device 10 for safely re-directing carbon monoxide exhaust 12 from generator 14. See FIGS. 1-5. Support 24 or a plurality of supports 24 may be configured to support holding mechanism 20 at elevated height 22 and in vertical orientation 26. Support or a plurality of supports 24 may include any device or devices, mechanism, and/or means configured to support holding mechanism 20 at elevated height 22 and/or in vertical orientation 26. As shown in the Figures, in square shape 78 embodiment of base 16, the at least one support 24 may include four supports 24 connected between each corner 82 of square shape 78 of base 16 and to holding mechanism 20.

Exhaust tube 28 may be included with device 10 10 for safely re-directing carbon monoxide exhaust 12 from generator 14. See FIGS. 1 and 3-5. Exhaust tube 28 may provide the conduit for re-directing carbon monoxide exhaust 12 from exhaust outlet 30 o safe exhaust height 34. Exhaust tube 28 may include any device or devices, mechanism, and/or means configured to re-direct carbon monoxide exhaust 12 from exhaust outlet 30 o safe exhaust height 34. Exhaust tube 28 may be configured to be connected to exhaust outlet 30 of generator 14 on first end 32. Exhaust tube 28 may be connected to exhaust outlet 30 of generator 14 by any means, including any mechanical fasteners, welds, adhesives, friction fittings, the like, etc. Exhaust tube 28 may be sized and configured to extend from exhaust outlet 30 of generator 14 vertically through holding mechanism 20 to safe exhaust height 34 above exhaust outlet 30 of generator 14. In select embodiments of device 10, exhaust tube 28 may include horizontal portion 46 and vertical portion 48. Horizontal portion 46 may include first end 32 configured to connect to exhaust outlet 30 of generator 14. Vertical portion 48 may be configured to extend vertically upward from horizontal portion 46 through holding mechanism 20 to safe exhaust height 34. In select embodiments, as shown in the Figures, exhaust tube 28 may further include bend portion 50 with radius 52. Bend portion 50 of exhaust tube 28 may be connected between horizontal portion 46 of exhaust tube 28 and vertical portion 48 of exhaust tube 28. In select embodiments, but clearly not limited thereto, bend portion 50 of exhaust tube 28 may bend 90 degrees from horizontal portion 46 to vertical portion 48 at radius 52. Radius 52 of bend portion 50 may be designed and configured to allow carbon monoxide exhaust 12 to flow freely from horizontal portion 46 of exhaust tube 28 to vertical portion 48 of exhaust tube 28.

Figure 1:
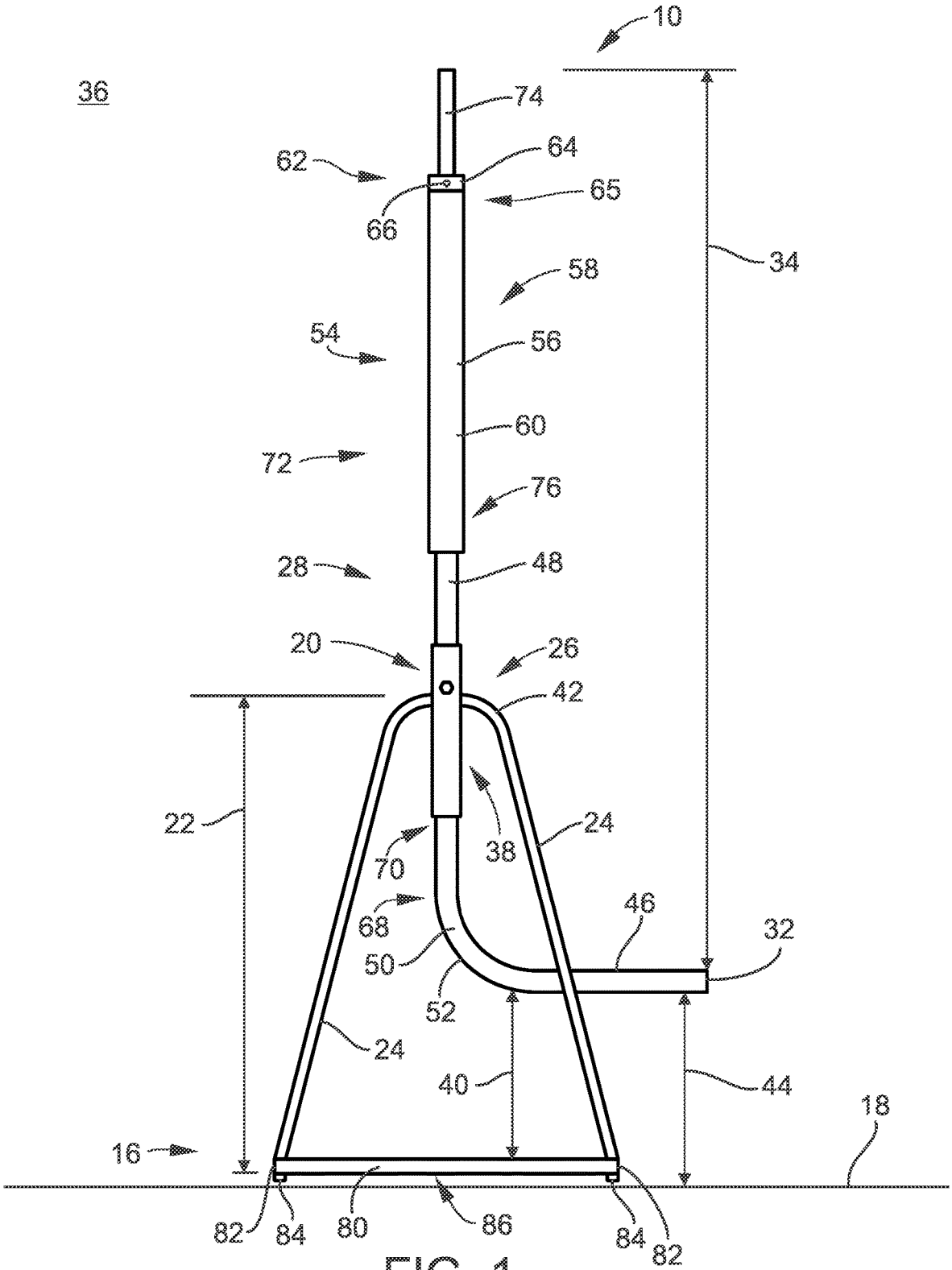
FIG. 1 is a side view of the device for safely re-directing carbon monoxide exhaust from generators according to select embodiments of the instant disclosure.
Figure 2:
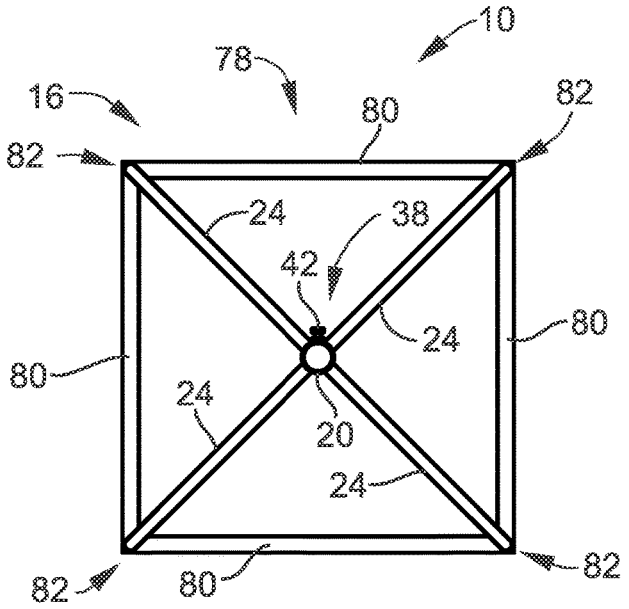
FIG. 2 is a top view of the base for the device for safely re-directing carbon monoxide exhaust from generators from FIG. 1.
Figure 3:
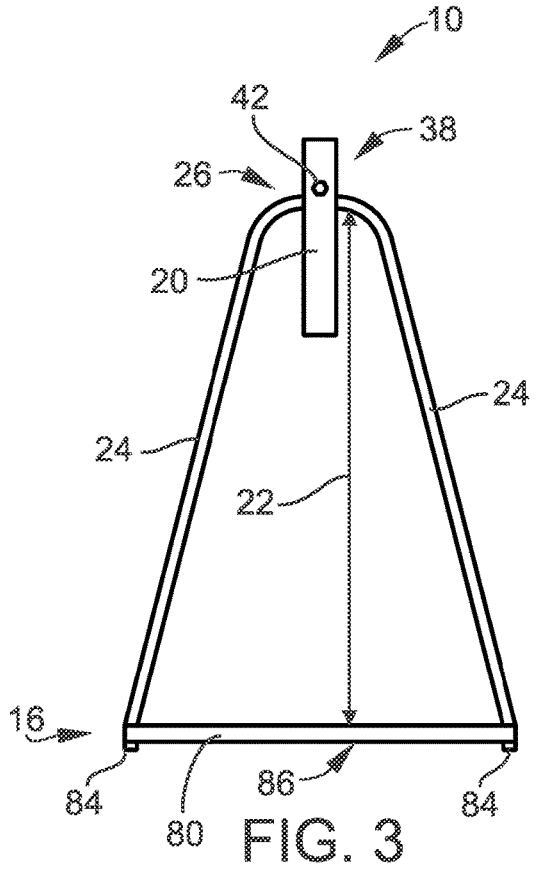
FIG. 3 is a side view of the base from FIG. 2 for the device for safely re-directing carbon monoxide exhaust from generators from FIG. 1.

Referring now specifically to FIGS. 1 and 5, another feature of device 10 for safely re-directing carbon monoxide exhaust 12 from generator 14 may be the inclusion of insulated portion 54 with exhaust tube 28. Insulated portion 54 may be configured to dissipate the heat of carbon monoxide exhaust 12 from generator 14. Insulated portion 54 may include any device or devices, mechanism, and/or means configured to dissipate the heat of carbon monoxide exhaust 12 from generator 14. Insulated portion 54 of exhaust tube 28 may be positioned above holding mechanism 20. In select embodiments, insulated portion 54 of exhaust tube 28 may be heat/burn shield 56 configured to provide hand moveable portion 58 of device 10 for manipulating device 10 during operation with generator 14. In select embodiments of insulated portion 54, and clearly not limited thereto, heat/burn shield 56 may be home gas pipe vent 60, as commonly known by one skilled in the art. In select embodiments of insulated portion 54, heat/burn shield 56 may be configured to dissipate the heat of the carbon monoxide exhaust from generator 14 by 50% or more. As examples, and clearly not limited thereto, during operation of generator 14, heat/burn shield 56 of device 10 for safely re-directing carbon monoxide exhaust gases 12 from generator 14 may reduce the temperature of such carbon monoxide exhaust gases 12 from generator 14 from around 203.5° F. to between approximately 80° F. and 102° F.

Still referring specifically to FIGS. 1 and 5, in select embodiments of device 10 for safely re-directing carbon monoxide exhaust 12 from generator 14, exhaust tube 28 may further include coupler 62. Coupler 62 may be configured for vertically positioning insulated portion 54 on exhaust tube 28. Coupler 62 may include any device or devices, mechanism, and/or means configured for vertically positioning insulated portion 54 on exhaust tube 28. In select embodiments, and clearly not limited thereto, as shown in the Figures, coupler 62 may be machined aluminum tube piece 64 connected to top end 65 of insulated portion 54 of exhaust tube 28. Machined aluminum tube piece 64 may be side drilled to receive set screw 66. Set screw 66 may be configured to allow insulated portion 54 to be adjustably positioned vertically on exhaust tube 28.

Referring now specifically to FIG. 4, in select embodiments of device 10 for safely re-directing carbon monoxide exhaust 12 from generator 14, exhaust tube 28 may include lower exhaust pipe 68 and upper exhaust pipe 72. As shown in FIG. 4, lower exhaust pipe 68 may include horizontal portion 46 and lower part 70 of vertical portion 48 configured to go through holding mechanism 20. Upper exhaust pipe 72 may include upper part 74 of vertical portion 48. Upper exhaust pipe 72 may be connected to lower exhaust pipe 68 may any means. In select embodiments, as shown in FIG. 4, upper exhaust pipe 72 may be connected to lower exhaust pipe 68 via flanged fitting 76. The use of this 2-piece construction of exhaust tube 28 may allow for easier breaking down for storage and/or transportation of device 10. However, the disclosure is not so limited, and a single piece exhaust tube 28 may be utilized or more than a 2-piece exhaust tube 28 may also be utilized.

Referring now specifically to FIG. 5, one feature of device 10 for safely re-directing carbon monoxide exhaust 12 from generator 14 may be that device 10 can be configured to re-direct carbon monoxide exhaust 12 from exhaust outlet 30 of generator 14 through exhaust tube 28 vertically to safe exhaust height 34 above exhaust outlet 30 of generator 14 into atmosphere 36.

In another aspect, the instant disclosure embraces device 10 for safely re-directing carbon monoxide exhaust 12 from generator 14 in any embodiment and/or combination of embodiments shown and/or described herein.

In another aspect, the instant disclosure embraces generator 14 (see FIG. 5) with device 10 for safely re-directing carbon monoxide exhaust 12 from generator 14 in any embodiment and/or combination of embodiments shown and/or described herein.

In sum, the purpose of the instant disclosure with device 10 for safely re-directing carbon monoxide exhaust 12 from generator 14 may be to provide a device to safely re-direct dangerous carbon dioxide emissions up into atmosphere 36 and away from people and/or pets. Carbon monoxide is heavier than air, thus venting it upwards into the atmosphere may greatly reduce the dangers of this gas collecting at the ground levels while running generators. Device 10 may include a sturdy square metal base 16 providing a solid footprint, stabilizing the unit, and giving a low center of gravity. Base 16 may greatly reduce the chances of the unit tipping or blowing over. An appropriately sized exhaust tube 28 or pipe like device may be included to allow enough back pressure to generator 14 for optimal cooling and efficiency of the engine yet allowing for the proper upward flow of spent gases. At the top of base 16, a ⅜-16 bolt (adjustment screw 42) in a threaded boss may be included to allow for height adjustment changes to match virtually any make/model generator 14, including, but not limited to, any portable, fixed or for recreational vehicle generators. Holding mechanism 20 may be a center tube suspended above base 16. The center tube of holding mechanism 20 may house the upper part 74 of lower exhaust pipe 68 and may secure it with the 3/18-16 bolt at its center. Upper exhaust pipe 72 may also be included. Upper exhaust pipe 72 may be the second piece of exhaust tube 28 extending from the top end of the center tube (i.e., holding mechanism 20). Upper exhaust pipe 72 may connect to lower exhaust pipe 68 via flanged fitting 76 and may extend upwards giving the unit an overall 125" height (safe exhaust height 34) to allow for the unit to expel gases above the height of a standard tow-behind enclosed trailer. Heat/burn shield 56, or insulated portion 54 of exhaust tube 28, may be included. Heat/burn shield 56 may be a 36" home gas pipe vent 60. The heat/burn shield insulator may be designed to fit over upper exhaust pipe 72 and may give a great thermal barrier to the direct heat of the exhaust tube 28 from a running generator 14. This heat/burn shield 56 insulator may work well at giving a thermal barrier that a generator running all day does not allow this piece to get so hot it can't be touched. In fact, after running all day, one can grab the insulator safely without risk of burns. This may be extremely valuable to any inadvertent contact when walking by the unit. Coupler 62 may also be included. Coupler 62 may be machined piece of aluminum 64 that keeps the heat/burn shield 56 insulator in place and can be adjusted by set screw 66 drilled into it. Coupler 62 may allow for the heat/burn shield 56 insulator to be adjustable to the operator's needs.

Example

As an example, and clearly not limited thereto, base 16 was constructed out of 1" square mild steel tubing, with 24" on each of the four side members 80 of square shape 78 of base 16. The uprights or supports 24 of base 16 were constructed out of ¾" OD round tubing or mild steel. They were welded top and bottom to base 16 and the center tube design for holding mechanism 20, forming a solid structure. Exhaust tube 28 was created from 1½" OD tubing of mild steel, like aluminized steel or stainless steel, and bent at 90 degrees. Lower exhaust pipe 68 of exhaust tube 28 was approximately 48" in overall length end-to-end and provided an overall height of approximately 26". Lower exhaust pipe 68 of exhaust tube 28 was connected to exhaust outlet 30 of generator 14 on first end 32 and upper exhaust pipe 72 on its other on the top of the device. A ⅜-16 threaded bolt was used for adjustment screw 42 of adjustment lock 38. This ⅜-16 threaded bolt was set in a threaded boss welded to the center tube of holding mechanism 20 that allows for multiple height adjustment settings of exhaust tube 28. The center tube of holding mechanism 20 was constructed of a 12" high, 1¾" OD mild steel material with the ⅜-16 threaded bolt as adjustment screw 42. Lower exhaust pipe 68 runs through the center tube of holding mechanism 20 and is adjusted by the ⅜-16 threaded bolt center adjustment screw 42. Upper exhaust pipe 72 was made of the same 1½ OD materials as lower exhaust pipe 68 of exhaust tubing 28. The total length of the upper exhaust pipe 72 was 90¾" long. Upper exhaust pipe 72 was attached to lower exhaust pipe 68 via flanged fitting 76 that extended the overall height of the device to extend past the height of an average enclose car trailer allowing for the safe venting of CO gases into atmosphere 36. Heat/burn shield 56 was used for insulated portion 54 and was created from a 36" home gas pipe vent 60. Heat/burn shield 56 insulator was slid over upper exhaust pipe 72 to provide protection to anyone within reach of the exhaust stack. Coupler 62 was machined from aluminum and side drilled to accommodate set screw 66 that allowed for height adjustment of heat/burn shield 56 insulator piece. This heat/burn shield 56 insulator piece acted as an excellent insulation device. It kept the heat contained to the exhaust tube 28 inside of heat/burn shield 56 insulator and away from the outside of insulated portion 54. This allowed for anyone within reach of this insulator to keep from accidental burns from making contact. Generator 14 used was run all day, yet the insulator could be touched and did not transfer sufficient heat to cause burns. A temperature sensor was used to read the temperatures of heat/burn shield 56 insulator piece. At various times throughout a day long use of generator 14, the temperature read from heat/burn shield 56 insulator piece was 88.7° F., 99.9° F. and 101.4° F. As such, at all times throughout the day long use of generator 14, insulated portion 54 of exhaust tube 28 was safe to the touch and could allow for the user or operator to move or adjust device 10. A temperature reading of exhaust outlet 30 and/or exhaust tube 28 was taken and read 203.5° F. As such, heat/burn shield 56 insulator piece was reducing or dissipating the heat or temperature of exhaust outlet 30 and/or exhaust tube 28 by at least 50%.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A device for safely re-directing carbon monoxide exhaust from a generator comprising:

a base configured to be positioned on a grounding surface;

a holding mechanism suspended at an elevated height from the base;

at least one support, each of the at least one support is connected between the base and the holding mechanism, where each of the at least one support is configured to support the holding mechanism at the elevated height in a vertical orientation;

an exhaust tube configured to be connected to an exhaust outlet of the generator on a first end, the exhaust tube is configured to extend from the exhaust outlet of the generator vertically through the holding mechanism to a safe exhaust height above the exhaust outlet of the generator;

wherein the holding mechanism includes an adjustment lock configured to adjustably secure the exhaust tube on or inside of the holding mechanism in a vertical position; and wherein the adjustment lock is an adjustment screw in the holding mechanism configured for adjustably securing the exhaust tube on or inside of the holding mechanism in the vertical position.

2. The device of claim 1, wherein the device is configured to re-direct the carbon monoxide exhaust from the exhaust outlet of the generator through the exhaust tube vertically to the safe exhaust height above the exhaust outlet of the generator into an atmosphere at the safe exhaust height.

3. The device of claim 1, wherein the adjustment lock is configured to adjust the vertical position of the exhaust tube on or inside of the holding mechanism at the elevated height above the base, whereby, the exhaust tube is configured to move vertically up and down within the exhaust tube and be secured at a required vertical exhaust height via the adjustment lock, where the required vertical exhaust height of the exhaust tube is configured for vertically positioning the first end of the exhaust tube with the exhaust outlet of the generator.

4. The device of claim 1, wherein the base has a square shape including four structural side members, wherein the at least one support includes four supports connected between each corner of the square shape of the base and the holding mechanism.

5. The device of claim 1, wherein the base includes at least one stabilizing base pad on a bottom side, each of the at least one stabilizing base pad are configured for stabilizing the base on the grounding surface.

6. The device of claim 5, wherein the base includes four stabilizing base pads on each corner of a square shape of the base.

7. The device of claim 1, wherein the exhaust tube includes:

a horizontal portion with the first end configured to connect to the exhaust outlet of the generator; and a vertical portion configured to extend vertically upward from the horizontal portion through the holding mechanism to the safe exhaust height.

8. The device of claim 7, wherein the exhaust tube includes a bend portion with a radius, the bend portion is connected between the horizontal portion of the exhaust tube and the vertical portion of the exhaust tube, wherein the bend portion of the exhaust tube bending 90 degrees from the horizontal portion to the vertical portion at the radius.

9. The device of claim 7, wherein the exhaust tube includes:

a lower exhaust pipe including the horizontal portion and a lower part of the vertical portion configured to go through the holding mechanism;

an upper exhaust pipe including an upper part of the vertical portion; and the upper exhaust pipe is connected to the lower exhaust pipe via a flanged fitting.

10. The device of claim 1, wherein the exhaust tube includes an insulated portion configured to insulate heat of the carbon monoxide exhaust from the generator.

11. The device of claim 10, wherein the insulated portion of the exhaust tube is positioned above the holding mechanism.

12. The device of claim 11, wherein the exhaust tube further includes a coupler, the coupler is configured for vertically positioning the insulated portion on the exhaust tube.

13. The device of claim 12, wherein the coupler is a machined aluminum tube piece connected to a top end of the insulated portion of the exhaust tube, the machined aluminum tube piece is side drilled to receive a set screw, the set screw is configured to allow the insulated portion to be adjustably positioned vertically on the exhaust tube.

14. The device of claim 11, wherein the insulated portion is a heat/burn shield configured to provide a hand moveable portion of the device for manipulating the device during operation with the generator.

15. The device of claim 14, wherein the heat/burn shield is a home gas pipe vent.

16. The device of claim 14, wherein the heat/burn shield is configured to dissipate the heat of the carbon monoxide exhaust from the generator by 50% or more.

17. A generator comprising:

a device for safely re-directing carbon monoxide exhaust from the generator, the device comprising:

a base configured to be positioned on a grounding surface;

a holding mechanism suspended at an elevated height from the base;

a plurality of supports connected between the base and the holding mechanism, the plurality of supports is configured to support the holding mechanism at the elevated height in a vertical orientation; and an exhaust tube configured to be connected to an exhaust outlet of the generator on a first end, the exhaust tube is configured to extend from the exhaust outlet of the generator vertically through the holding mechanism to a safe exhaust height above the exhaust outlet of the generator;

wherein, the exhaust tube includes:

a horizontal portion with the first end configured to connect to the exhaust outlet of the generator;

a vertical portion configured to extend vertically upward from the horizontal portion through the holding mechanism to the safe exhaust height;

a lower exhaust pipe including the horizontal portion and a lower part of the vertical portion configured to go through the holding mechanism;

an upper exhaust pipe including an upper part of the vertical portion; and the upper exhaust pipe is connected to the lower exhaust pipe via a flanged fitting.

18. A device for safely re-directing carbon monoxide exhaust from a generator comprising:

a base configured to be positioned on a grounding surface;

a holding mechanism suspended at an elevated height from the base;

at least one support, each of the at least one support is connected between the base and the holding mechanism, where each of the at least one support is configured to support the holding mechanism at the elevated height in a vertical orientation; and an exhaust tube configured to be connected to an exhaust outlet of the generator on a first end, the exhaust tube is configured to extend from the exhaust outlet of the generator vertically through the holding mechanism to a safe exhaust height above the exhaust outlet of the generator, wherein the exhaust tube includes:

a horizontal portion with the first end configured to connect to the exhaust outlet of the generator;

a vertical portion configured to extend vertically upward from the horizontal portion through the holding mechanism to the safe exhaust height;

a lower exhaust pipe including the horizontal portion and a lower part of the vertical portion configured to go through the holding mechanism;

an upper exhaust pipe including an upper part of the vertical portion; and the upper exhaust pipe is connected to the lower exhaust pipe via a flanged fitting.

* * * * *